United States Patent [19]

Magalhaes

[11] 4,243,179

[45] Jan. 6, 1981

[54] PROCESS FOR PREPARATION OF RAW MATERIAL MINIMIZING THE SIZE DEGRADATION OF ANATASE ORE

[76] Inventor: Gustavo Magalhaes, rua Professor Almeida Cunha No. 196, Belo Horinzonte, Minas Gerais, Brazil

[21] Appl. No.: 971,267

[22] Filed: Dec. 20, 1978

[30] Foreign Application Priority Data

Jan. 31, 1978 [BR] Brazil ..... 7800586

[51] Int. Cl.[3] ..... B02C 23/14

[52] U.S. Cl. ..... 241/24; 241/29

[58] Field of Search ..... 241/14, 24, 29; 209/2, 209/5, 3, 39, 214, 12

[56] References Cited

U.S. PATENT DOCUMENTS

| | | | |
|---|---|---|---|
| 2,514,958 | 7/1950 | Lee | 209/2 X |
| 2,957,818 | 10/1960 | Fischer | 209/5 X |
| 3,022,956 | 2/1962 | Haseman | 241/24 |

*Primary Examiner*—Richard B. Lazarus

*Attorney, Agent, or Firm*—Emory L. Groff, Jr.

[57] ABSTRACT

Invention patent for "Process for preparation of raw material, minimizing the grain size degradation of anatase ore". The process basically consists of the removal of the minerals more resistant to comminution than anatase, before its grinding stage. The process includes the wet disaggregation of the ore, screening and crushing of the ore originating in the disaggregation step, classification, screening of the coarse product of the classification, magnetic concentration, grinding for liberation of anatase and desliming followed by thickening, filtering and drying of the material.

1 Claim, No Drawings

PROCESS FOR PREPARATION OF RAW MATERIAL MINIMIZING THE SIZE DEGRADATION OF ANATASE ORE

This invention describes a process for preparation of raw material, which makes it possible to reduce the grain size degradation of the mineral anatase to a minimum.

The processes which use titanium raw materials such as rutile, leucoxene, ilmenite and also semi-processed products, such as synthetic rutile and slags with high titanium content require that the grain size consist of these products should be situated in a narrow range and, very often, that they should have no ultra-fines, which are particles under 74 microns.

The adequacy of a concentration process to the characteristics of the ore, especially those originating in alkaline chimneys, can provide a concentrate with rather coarse grain size distribution, resulting in a product which is very competitive in the international market. This positive result can be achieved without any disadvantage to the recovery of titanium and with great reduction in the energy consumption.

Another aspect to be taken into consideration is that all the operations involved are mechanical and do not require the use of chemical reagents, avoiding the problem of polluting effluent substances.

As to its mineralogical characteristics related to its conduct during the grinding, anatase is not very resistant, being quickly comminuted while the other minerals constituting the ore still maintain coarse sizes. The very hard minerals must be removed from the process before grinding the anatase, making it fit for the following stages of the concentration process.

The clayish minerals, which occur in the ore, have a positive influence if wet classification operations are used, because the presence of these minerals is characterized by the fact that they densify the pulps and considerably improve the viscosity, making the separation of siliceous minerals possible.

This invention describes a simple, efficient and cheap process for the preparation of titanium ore which basically consists of the following operations:

(a) disaggregation
(b) screening and crushing
(c) classification
(d) screening
(e) magnetic concentration
(f) grinding; and (g) desliming In the disaggregation, which is a wet operation, the ore is revolved in a rotative drum, scrubber type, aiming at cleaning the mineral particles, uncovering them of the clayish layer which involves them. The percentage of solids in this operation is superior to 40%.

In the stage of screening and crushing, the ore originating in the previous operation is reduced to a grain size range adequate to classification, the maximum allowed particle size being of the order of 19.05 mm ¾").

Then the classification is carried out with a high percentage of solids. A value superior to 20% for the classifier over-flow is maintained.

In the screening step, the classification coarse product undergoes the screening. Thus narrow grain size ranges are obtained, which are consistent with the following magnetic concentration stage.

In the magnetic concentration, carried out in magnetic fields of low and medium intensity, the highly sensitive magnetic ores are removed, especially magnetite and ilmeno-magnetite.

The magnetic product is discarded from the process while the non-magnetics undergo a new classification, which is characterized by the low percentage of solids, inferior to 10%, in the classifier overflow.

The coarse product of this operation is stored in piles, the aim of which is to act as flow regulators in the process and to homogenize the material, making the control of the following concentration stages easier.

In the grinding step, anatase is liberated from its gangues. The grinding step is carried out in a circuit designed to avoid, as far as possible, the production of ultra-fines. The mill is of the peripherical discharge type and the graduation system is of the micro-screen type. The screen opening is a function of the liberation and of the specifications required by the market.

At last, in the desliming step, the material is deslimed, thickened, filtered and dried after it leaves the grinding circuit.

EXAMPLE

A sample weighing 12.9 tons has undergone tests in a pilot scale plant with capacity for 2.5 tons/h of feeding.

The results obtained in the process are shown in the flowsheet illustrated in the single FIGURE of the enclosed drawing.

As one can notice, the rise of the $TiO_2$ content from about 25% to about 50%, with a recovery of $TiO_2$ superior to 60% and the grain size of the product completely situated in the range of 0.074–9.0 mm are distinguished.

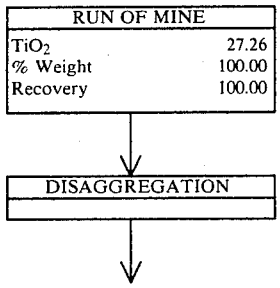

-continued

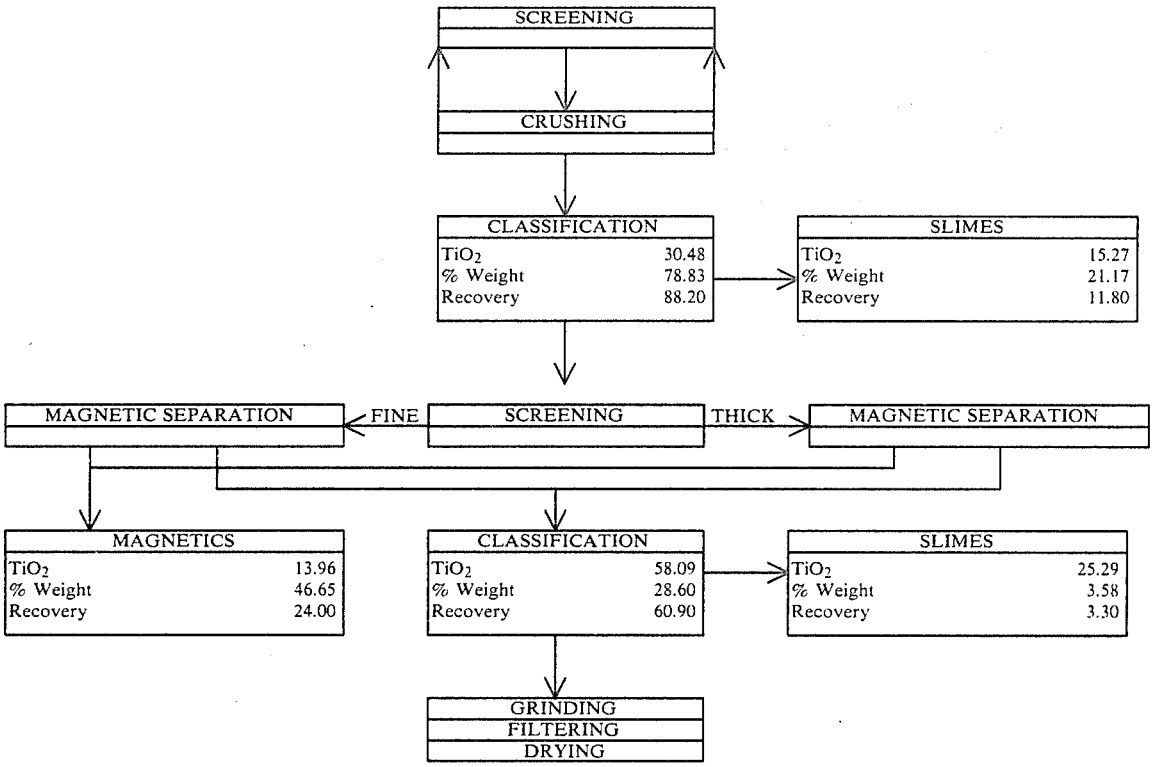

I claim:

1. A process for the concentration of anatase ore wherein grain size degradation is minimized comprising:

(1) wet disaggregation of anatase ore in a rotating drum, wherein the percentage of solids is greater than 40%;

(2) screening and crushing the wet-disaggregated ore to a grain size having a maximum size of about 19 mm;

(3) classification, wherein the percentage of solids is greater than 20%;

(4) screening of the classified product;

(5) magnetic concentration to remove magnetizable minerals;

(6) grinding the non-magnetic fraction to liberate anatase from the gangues while avoiding the formation of ultra-fines; and (7) desliming the anatase followed by thickening, filtering and drying.

* * * * *